US010883782B2

(12) United States Patent
Apostolopoulos

(10) Patent No.: US 10,883,782 B2
(45) Date of Patent: Jan. 5, 2021

(54) INTEGRATED SAFETY APPARATUS AND DYNAMIC PROTECTION ZONE SYSTEM

(71) Applicant: 412 TECHNOLOGIES INC., Toronto (CA)

(72) Inventor: Stavros Apostolopoulos, Toronto (CA)

(73) Assignee: 412 TECHNOLOGIES INC., Toronto (CA)

( * ) Notice: Subject to any disclaimer, the term of this patent is extended or adjusted under 35 U.S.C. 154(b) by 0 days.

(21) Appl. No.: 16/820,434

(22) Filed: Mar. 16, 2020

(65) Prior Publication Data

US 2020/0300569 A1 Sep. 24, 2020

Related U.S. Application Data

(60) Provisional application No. 62/821,225, filed on Mar. 20, 2019.

(51) Int. Cl.
*F41A 17/08* (2006.01)

(52) U.S. Cl.
CPC ..... *F41A 17/08* (2013.01)

(58) Field of Classification Search
CPC ..... F41A 17/08; F41A 27/02; F41A 17/063
See application file for complete search history.

(56) References Cited

U.S. PATENT DOCUMENTS 6,785,996 B2 9/2004 Danner et al.
6,856,238 B2 * 2/2005 Wootton ..... F41A 17/063 340/10.1
8,127,482 B2 * 3/2012 O'Shaughnessy .... F41A 17/063 42/70.11
8,850,944 B2 10/2014 Zhou
9,250,030 B2 2/2016 Henry
9,261,315 B2 * 2/2016 Travis ..... F41A 17/06
9,710,836 B1 7/2017 O'Malley
9,810,498 B1 * 11/2017 Winiecki ..... F41A 17/46
10,222,158 B2 * 3/2019 Milde, Jr. ..... F41A 17/08
10,264,395 B1 * 4/2019 Milde, Jr. ..... H04W 4/021
2014/0182179 A1 * 7/2014 McHale ..... F41A 17/48 42/70.06
2014/0230296 A1 * 8/2014 Kuparinen ..... F41A 17/08 42/1.01
2014/0298701 A1 10/2014 Peng
2014/0366421 A1 * 12/2014 Arif ..... F41A 17/00 42/70.11
2019/0376756 A1 * 12/2019 Nieh ..... F41A 17/08

FOREIGN PATENT DOCUMENTS

CA 2 839 381 C 11/2018
WO WO 2014/142920 A1 9/2014

* cited by examiner

*Primary Examiner* — Reginald S Tillman, Jr.
(74) *Attorney, Agent, or Firm* — Birch, Stewart, Kolasch & Birch, LLP

(57) ABSTRACT

Methods, systems, and apparatus for activating an on-firearm locking system of a firearm in a firearm safety apparatus and dynamic variable protection system. A determination may be made that a firearm with an on-firearm locking system is within a predetermined distance of a target affixed with a transmitter/receiver safety device. The firearm may be tracked while the firearm is within the predetermined distance of the target. A no-shoot arc for the firearm may be calculated for the firearm and a command may be sent to activate the on-firearm locking system of the firearm when the firearm is within a no-shoot zone surrounding the target to prevent the firearm from being fired into the no-shoot zone.

8 Claims, 9 Drawing Sheets

INTEGRATED SAFETY APPARATUS AND DYNAMIC PROTECTION ZONE SYSTEM

CROSS-REFERENCE TO RELATED APPLICATIONS

This application claims the benefit under 35 U.S.C. § 119(e) of the filing date of U.S. Patent Application No. 62/821,225 for INTEGRATED SAFETY APPARATUS AND DYNAMIC PROTECTION ZONE SYSTEM, which was filed on Mar. 20, 2019, and which is incorporated here by reference.

BACKGROUND

This specification relates to firearm safety and protection systems.

Firearms, including high-powered automatic and semi-automatic firearms, have become pervasive in society. Widespread availability and easy access to these weapons has led to an increase in mass shooting incidents, especially at target sites, e.g. persons, a cluster of communication devices, schools, hospitals, government facilities, and entertainment event venues. Unfortunately, during a given incident, a shooter of a powerful firearm is usually able to fire rapidly with precise accuracy causing significant casualties and loss of life before law enforcement personnel are able to arrive on the scene.

SUMMARY

This specification describes technologies relating to firearms and protection systems in general, and specifically to integrating an on-firearm apparatus with a dynamic variable protection zone system and real-time identification to quickly provide information about a shooter, the shooter's firearm, and to disable the shooter's firearm prior to or during an active shooting without having to disable all firearms within the dynamic protection zone.

In general, one innovative aspect of the subject matter described in this specification can be embodied in systems for identifying and disabling discrete firearms at pre-determined arcs of aim and range within a dynamic variable protection zone.

One innovative aspect of the invention is an on-firearm locking system that automatically disables, e.g., locks, a firearm at pre-determined points, e.g., arcs of aim and range within particular zones, to stop the firearm from being able to shoot into an area surrounding a target.

A second novel aspect of the invention is a safety zone system that performs a computer-implemented method to disable particular firearms within a specified distance and pointed within a determined arc of a target.

One innovative embodiment is a method that includes: determining that a firearm with an on-firearm locking system is within a predetermined distance of a target affixed with a transmitter/receiver safety device. The method tracks the firearm, including a location of the firearm as well as a type of the firearm and an owner of the firearm, while the firearm is within the predetermined distance of the target. The method determines whether a muzzle of the firearm has a relative bearing to the target and calculates a diameter of a ring of protection for the target by determining a maximum projection range for ammunition for the firearm and a predetermined safety margin range. A no-shoot arc for the firearm is calculated using a safety margin of a predetermined amount of degrees of arc and the relative bearing of the muzzle of the firearm. The method sends a command to activate the on-firearm locking system of the firearm when the firearm is within a no-shoot zone surrounding the target, as determined by the diameter of the ring of protection and the no-shoot arc, to prevent the firearm from being fired into the no-shoot zone.

Another innovative embodiment is a system comprising a firearm with an on-firearm locking system that is configured to enable an on-firearm locking apparatus in response to an activate command; a target with a transmitter/receiver device; and a processor that is configured to obtain a position of the target; obtain a position of the firearm; determine whether the firearm is within a no-shoot zone of the target; and when the firearm is determined to be within a no-shoot zone of the target, send an activate command to the firearm to enable the on-firearm locking apparatus.

In some implementations the no-shoot zone is defined by two zones, a non-operative shooting zone with the target at its center and a variable no-penetration zone for each particular weapon that serves as a ring surrounding the non-operative shooting zone.

In some implementations, the system or method further includes sending a command to deactivate the on-firearm locking system of the firearm when the firearm is outside the no-shoot zone.

In some implementations, the system or method further includes tracking communication devices within the predetermined distance of the target; and sending messages to the communication devices with safety instructions when the firearm is within the predetermined distance of the target.

In some implementations, the target is a cluster of communication devices identified in a specific geographic area.

In some implementations the variable no-penetration zone for a particular firearm is determined by adding a predetermined distance to the non-operative shooting zone based on characteristics of the particular firearm.

In some implementations, the predetermined distance to be added is calculated based on the firearm make, a maximum ammunition load for the firearm, a shooting distance for the maximum ammunition load, and a fixed safety margin expressed as an additional percentage of a maximum shooting distance for the ammunition load.

In some implementations, prior to sending the command to activate the on-firearm locking system of the firearm, the system or method determines whether the firearm is authorized to work within the no-shoot zone surrounding the target; and sends the command to activate the on-firearm locking system of the firearm upon determination that the firearm is not authorized to work within the no-shoot zone.

Another innovative embodiment is an apparatus including a power supply, a central processing unit (CPU), a data entry port configured to communicate with the CPU, a memory storage component configured to communicate with the CPU, a communication module configured to communicate with the CPU, a fluxgate compass component configured to communicate with the CPU, a transmitting/receiving component configured to communicate with the CPU; and a hard wire or wireless connection between the switching processing component and a remote trigger safety switch component proximate to a traditional on-firearm manual safety switch.

In some implementations, when the communication module receives a command to activate the remote trigger safety component, the communication module sends the command to the CPU, and the CPU sends the command to the switching process to activate the remote trigger safety switch component.

In some implementations, when the communication module receives a command to deactivate the remote trigger safety component, the communication module sends the command to the CPU and the CPU sends the command to the switching process to deactivate the remote trigger safety switch component.

In some implementations, in the apparatus all components except the hard wire or wireless connection, the switching processing component, and the remote trigger safety switch component are mounted on a circuit board that can be integrated into a butt, butt cap, or pistol grip of the apparatus.

In some implementations, the remote trigger safety switch is a safety pin mechanism implemented with a cam of irregular shape.

In some implementations, the remote trigger safety switch is an intermittent pin/ratchet/pawl that includes a disc that can be fixed to a motor shaft and move an off-centered pin or piston into a locking position.

The subject matter described in this specification can be implemented in particular embodiments so as to realize one or more of the following advantages.

The firearm safety apparatus and dynamic variable protection zone system of the present invention allow for discrete disabling of firearms located within a proximate distance of a target. The dynamic variable protection zone system of the present invention can enable an on-firearm locking system for a particular firearm within a predetermined distance of the target and/or with a muzzle pointed in a determined no-shoot arc aimed at the target. Enabling the on-firearm locking system prevents the firearm from discharging in the direction of the target. The system can distinguish among firearms so that the system can still allow police and security personnel firearms to discharge within the predetermined distance and/or within the no-shoot arc without allowing potential malicious shooters to fire their weapons.

As another advantage, the firearm safety apparatus and dynamic variable protection zone system can track and identify firearms and owners within the proximate distance of the target. Therefore, information associated with the firearm, e.g., identification of a shooter, the firearm, the ammunition type, and location of the firearm, is not dependent upon eye witness accounts conveyed to responding law enforcement. Instead, the position of the firearm and accurate information about the shooter can be conveyed from the system itself which is in communication with the firearm.

Conventional firearm safety apparatuses are usually manual and can easily be overridden. For example, a firearm may have a static manual safety mechanism on the weapon intended to prevent accidental discharge that can be manually disabled. Some conventional firearms may alternatively have manual trigger/hammer and ammunition magazine lock apparatuses that are easy to override by physically breaking the locks or creating copies of the keys. FIGS. 5-7 illustrate conventional safety apparatuses.

FIG. 5 illustrates a trigger safety of a firearm. A trigger safety is the first safety in a firing sequence and is incorporated into the trigger in the form of a lever. When the trigger safety is engaged, the safety stops the trigger from moving backward. To fire a weapon, the trigger safety and the trigger must be depressed simultaneously.

FIG. 6 illustrates a firing pin safety of a firearm. A firing pin safety is a mechanical block that stops forward movement of the firing pin. This safety is linked to the trigger mechanism of a weapon and clears the obstruction to the pin just before the hammer or striker is released.

FIG. 7 illustrates a drop safety on a firing pin. This safety stops the firing pin from traveling forward and striking the primer. The safety reduces the chance of a firearm accidentally discharging when dropped or roughly handled.

Other conventional firearms may have coded locks that require owner identification, e.g., fingerprint, palm print, or voice recognition, or be enabled when the proximity of an enabling device is in the possession of a legitimate owner. However, the legitimate owner may choose to unlock his or her firearm and use it for malicious purposes. Additional conventional weaponry (i.e., the Glock brand weaponry) does not have a manual safety per se, but relies upon a three safety check system comprising the application of additional trigger pressure to override the trigger lock, a bolt lock, and a drop firing pin lock within the weapon.

An aspect of the present invention provides an advantageous switching processor that prevents manual override of an on-firearm locking system. Therefore, a shooter cannot manually disable safety mechanisms in order to use firearms to cause harm to targets.

The details of one or more embodiments of the subject matter of this specification are set forth in the accompanying drawings and the description below. Other features, aspects, and advantages of the subject matter will become apparent from the description, the drawings, and the claims.

BRIEF DESCRIPTION OF THE DRAWINGS

Like reference numbers and designations in the various drawings indicate like elements.

DETAILED DESCRIPTION

This specification generally describes a firearm safety apparatus and dynamic variable protection system that can discretely disable firearms located within a proximate distance of a target, e.g., a person, cluster of communication devices, vehicle, structure or entertainment event venue, that is relatively unprotected or vulnerable to attack.

Figure 1:
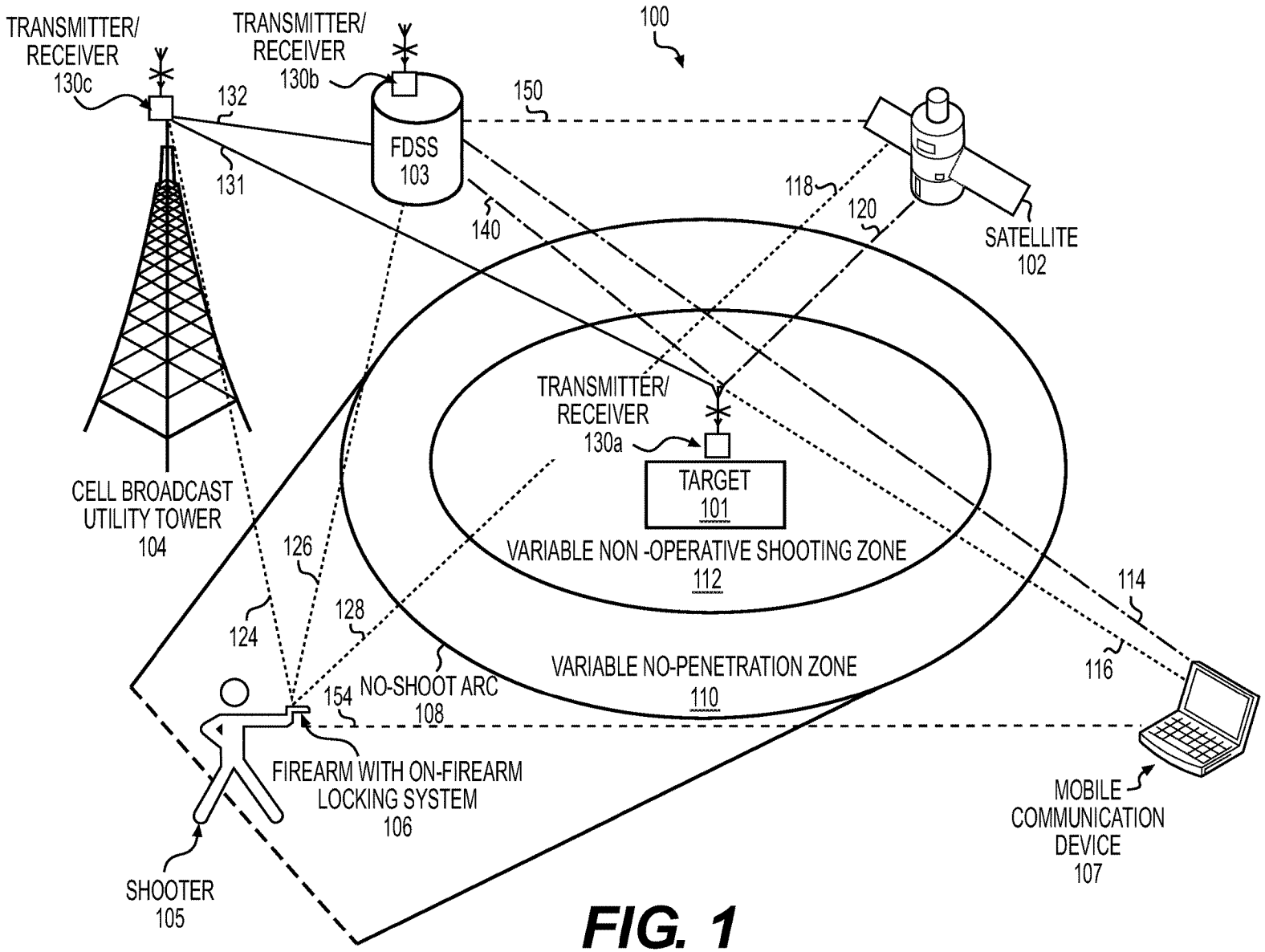
FIG. 1 illustrates an example firearm safety apparatus and dynamic variable protection system.

FIG. 1 shows an example firearm safety apparatus and dynamic variable protection system 100. The system 100 includes a target 101 affixed with a transmitter/receiver device 130*a*. The target 101 can be any designated target, e.g., a school, hospital, government facility, parade or motorcade route, vehicle, aircraft, vessel, or entertainment event venue. In some instances, the target 101 may even be a person or a cluster of communication devices.

In one implementation, the transmitter/receiver device 130*a* can include a geo-locator to provide the location of the target 101. In another implementation, the geo-locator may be a standalone geo-locator device sending information to the transmitter/receiver 130*a*.

The transmitter/receiver device 130*a* can be permanently or temporarily affixed to the target 101. The transmitter/receiver device 130*a* communicates with other devices and geo-locaters in order to assist in the identification of the approximate location of the target 101, and can be used to calculate relative bearings between a potential or active shooter 105 using a firearm fitted with an on-firearm locking system 106 and the target 101. The transmitter/receiver device 130*a* can have a connection 120 to a GPS satellite 102, a connection 131 to a cell broadcast utility tower 104 that can include a transmitter/receiver 130*c*, or a connection 116 to a mobile communication device 107. These connections can be wired or wireless and direct or over a network.

Figure 3:
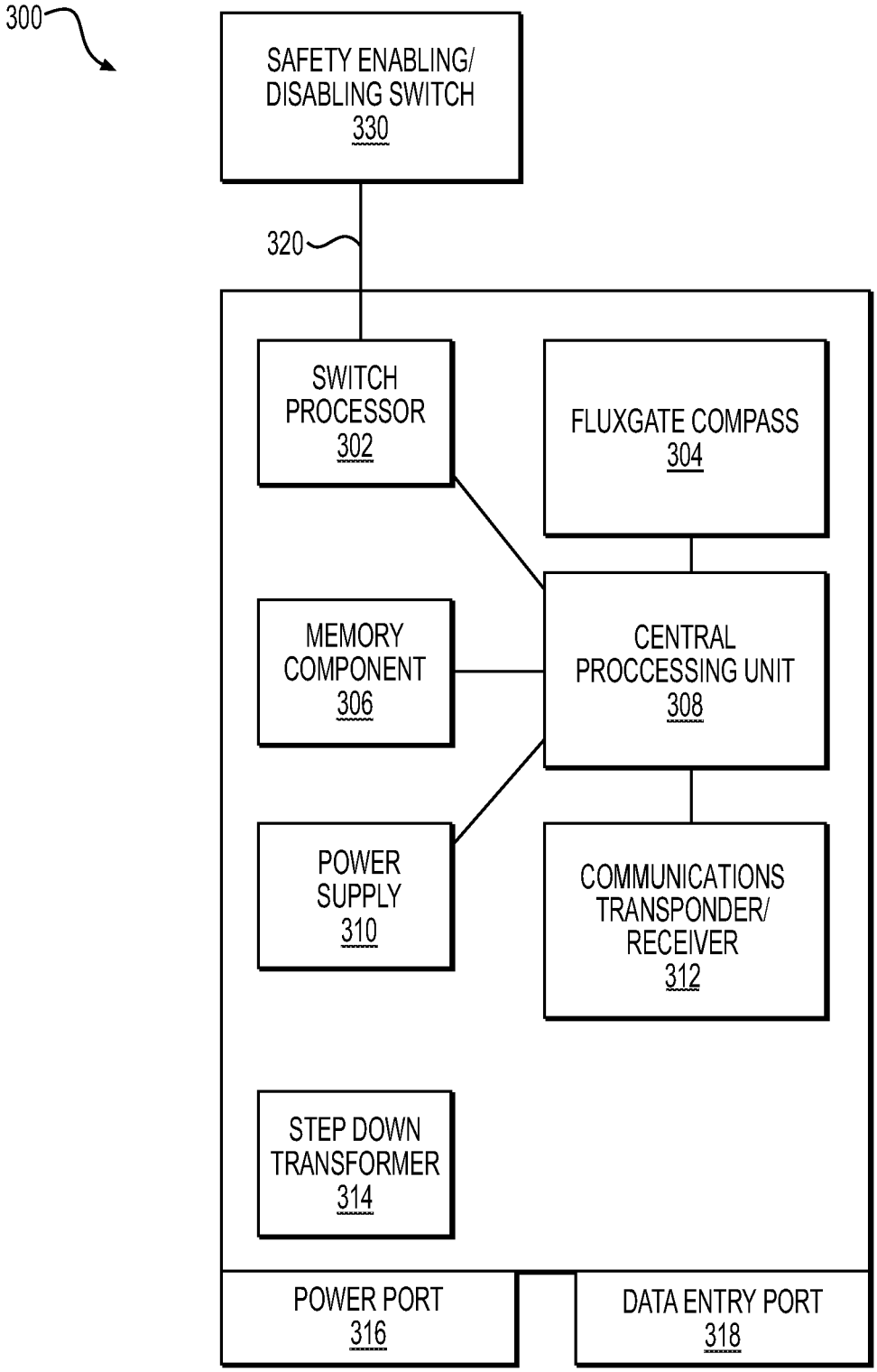
FIG. 3 illustrates a microcircuit card/board for the on-firearm locking system.

In another implementation, the transmitter/receiver 130*a* is in direct communication with a communication transponder/receiver, e.g., the communication transponder/receiver 312 of FIG. 3, on a microcard within a firearm. Communication may be facilitated using wireless communication, e.g., by WiFi, RFD, NFC, or Bluetooth.

As illustrated in FIG. 1, the example firearm safety apparatus and dynamic variable protection system 100 includes a Firearms Distress and Safety System (FDSS) 103. The Firearms Distress and Safety System 103 includes one or more memory components that hold registration files for each firearm fitted with an on-firearm locking system 106. Each registration file contains information about a particular firearm and the firearm's registered owner, e.g., the owner's name, the owner's address, special issues reported about the owner, the type of firearm, optimal and variable ammunition rounds and loads for the firearm, the muzzle velocity and projectile range of the ammunition for the firearm, and cross-references to other firearms owned by the particular owner. The registration file can be created when the firearm is purchased or retro-fitted with an on-firearm locking system and can be updated when the firearm is transferred or sold to a new owner. Since the Firearms Distress and Safety System 103 includes this information, the Firearms Distress and Safety System 103 can easily provide the information to law enforcement personnel, first responders, or others who need to know the identity, location, or other information about a potential or active shooter. Communication devices, e.g., mobile communication device 107, belonging to those who need to know information about a firearm owner can connect to the Firearms Distress and Safety System 103 and obtain information about the firearms within a proximate distance to a particular target 101. The Firearms Distress and Safety System 103 may also contain information regarding the firearm or firearms associated with an active shooter. In one implementation, the Firearms Distress and Safety System is a dynamic system that sends information to monitoring authorized security personnel at or in proximity to or even remote from the target. The Firearms Distress and Safety System may send and receive information using wireless or wired communication.

The Firearms Distress and Safety System 103 can also include at least one variable programmable data unit that generates pre-programmed or manually input commands to the transmitter/receiver 130*a* on the target 101 and to firearms with on-firearm locking systems 106 within a proximate distance of the target 101.

The Firearms Distress and Safety System 103 is in communication, using a connection 140, with the transmitter/receiver device 130*a*. The Firearms Distress and Safety System 103 contains computing and at least one receiving/transmitting device 103*b* in communication with the GPS satellite 102 over a connection 150, with the cell broadcast utility tower 104 over a connection 132, or the mobile communication device 107 over a connection 114. These connections can be wired or wireless and direct or over a network.

The commands of the variable programmable data unit can include commands that specify a no-shoot zone using one or more of a date, time of day, duration, and a diameter of the no-shoot zone with the target 101 at the center of the zone. The no-shoot zone may be defined by two zones, i.e., the site or location specific non-operative shooting zone 112 with the target at its center, and a variable no-penetration zone 110 for each particular weapon that serves as a ring surrounding the site or location specific non-operative shooting zone 112.

Commands generated by the Firearms Distress and Safety System 103 can include commands to enable the on-firearm locking apparatus of the on-firearm locking system 106 and disable the on-firearm locking apparatus of the on-firearm locking system 106.

The Firearms Distress and Safety System 103 can also track cell phone and smart devices through cell communications, wireless communication, or geo-location data. The system can send text or audible messages to the holders of the devices with safety and evacuation instructions. For example, the system may provide the devices with information to shelter in place or that there is no longer an active threat. The information about the situation can be updated at regular intervals to provide current details regarding the situation as well as the location of the active shooter.

The Firearms Distress and Safety System 103 can also be programmed to identify specific densities of cell phone or smart device users in a given geographic area. The system can also track cell phones and smart devices in geographic areas to identify density patterns as targets creating a non-operative shooting zone surrounding the cluster of cellphone and smart device users. By allowing densities of people (or device users) to be targets, the system can make temporal targets that focus on groups of people such as concert goers at an outdoor concert or festival or crowded transit areas.

Alternatively, the pre-programmed or manually input commands can be generated by the target 101 and relayed to the Firearms Distress and Safety System 103 and to the firearms within a proximate distance beyond the no-shoot zone that have the on-firearm locking systems 106. These commands can be input by a person at, or remote from, the target. In some implementations, law enforcement personnel may input commands. In some implementations, the commands can be preprogrammed at the target or remotely to go on and off at set times of the day during set days of the year, e.g., during school hours on Monday through Friday during the school year.

A variable non-operative shooting zone 112 is considered a no-shoot zone and a variable no-penetration zone 110 is considered a zone in which a firearm is inoperable when the barrel is pointed in a direction towards a target 101 within a no-shoot arc.

The variable no-penetration zone 110 for a particular firearm is established by adding distance to a predetermined non-operative shooting zone 112. The system adds a distance out from the center of the non-operative shooting zone 112 calculated based on the firearm make, the most powerful ammunition load for the firearm, the shooting distance for that maximum ammunition load, and a fixed safety margin expressed as an additional percentage of the maximum shooting distance for the ammunition load. The Firearms Distress and Safety System 103 may include a database that maintains the range distance of every bullet type for each make and model of weapon. This information may be based upon published manufacturer specifications cross-referenced against the make and model of a particular weapon to determine the most powerful ammunition for that particular weapons and the range and added range safety margin for that projectile.

The effective range (i.e., distance travelled) by any particular bullet can be expressed as a function of the muzzle velocity or muzzle energy of the projectile. For example, if the firearm is identified by the system as a Colt 45 handgun, a database will note that the most powerful ammunition for the firearm is a cartridge that has a shooting distance of approximately 2,000 ft. If the safety margin is approximately 40% of the maximum shooting distance for the ammunition load, then the radius of the variable no penetration zone 110 determined beyond the non-operative shooting zone 112, is the 2,000 ft range with an additional 800 ft calculated by taking 40% of 2,000 ft to determine the variable no penetration zone 110 for the firearm.

Within the non-operative zone 112 no weapon works in any direction other than authorized weaponry. The particular firearm, e.g., Colt 45 handgun, would not work within the no-shoot arc starting at the outer perimeter of the particular variable no-penetration zone 110 for the particular firearm.

In some implementations, some weapons may be authorized to work within the non-operative zone 112. However, if an authorized weapon is commandeered by a malevolent shooter or an authorized weapon is used by a rogue authorized user, the weapon could be disabled by the system. When the Firearms Distress and Safety System is notified that a weapon has been commandeered, e.g., when an assailant steals the weapon away from law enforcement, the system can treat the formerly authorized firearm as a non-authorized firearm. The firearm would then not be operative in the non-operative zone 112 or in the no-shoot arc established for that firearm in the no-penetration zone 110.

As illustrated in FIG. 1, a mobile communication device 107 can be in communication over a connection 116 with the transmitter/receiver 130*a* of the target 101 and/or the Firearms Distress and Safety System 103 over a connection 114. The mobile communication device 107, e.g., a vehicle, a smart phone, or a laptop computer, can help establish the geo-location of a firearm with an on-firearm locking system 106 in proximate distance to the target 101. The firearm safety apparatus and dynamic variable protection system 100 can establish and maintain the geolocation of firearms with the on-firearm locking system 106 in proximity to the target 101 using communications among the GPS satellite 102 over a connection 128, cell broadcast utility tower 104 over a connection 124, and the mobile communication device 107 over connection 154, as well as location information from the firearm locking system, i.e., a fluxgate compass reading in the firearm. The system 100 can record the firearm location and its trajectory, as well as law enforcement, first responders and security personnel location, and instructional information conveyed to cell phones and smart devices as well as their location, in the Firearms Distress and Safety System 103 and/or at the target 101 for archival or forensic purposes.

Figure 2:
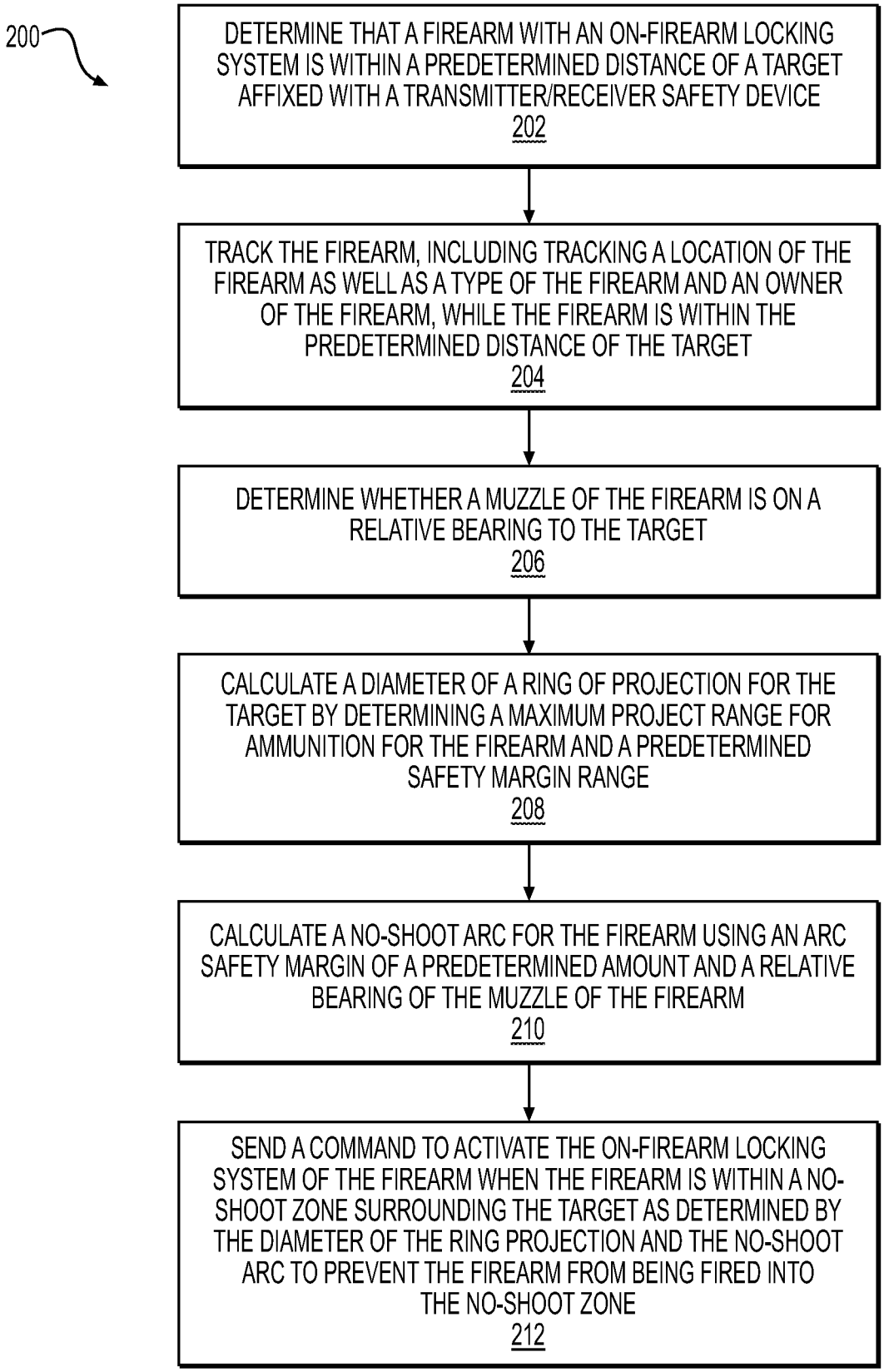
FIG. 2 is a flow diagram of an example process for activating an on-firearm locking system of a firearm in a firearm safety apparatus and dynamic variable protection system.

FIG. 2 is a flow diagram of an example process 200 for activating an on-firearm locking system of a firearm in a firearm safety apparatus and dynamic variable protection system. For convenience, the process 200 will be described as being performed by a system of one or more computers, located in one or more locations, and programmed appropriately in accordance with this specification. For example, a firearm safety apparatus and dynamic variable protection system, e.g., the firearm safety apparatus and dynamic variable protection system 100 of FIG. 1, appropriately programmed, can perform the process 200.

The system begins the activation process by determining that a firearm with an on-firearm locking apparatus is within a predetermined distance of a target affixed with a transmitter/receiver safety device 202. The system tracks the firearm, including tracking a location of the firearm as well as a type of the firearm and an owner of the firearm, while the firearm is within the predetermined distance of the target 204. The system also determines whether a muzzle of the firearm is on a relative bearing, i.e., pointing at the target, to the target 206. This determination can be automatic and ongoing using traditional computerized relative bearing fix calculations taken and retaken at regular short intervals calculated in nanoseconds at the muzzle of the firearm as determined by the compass heading or bearing on the fluxgate compass in the firearm. The system calculates a diameter of a ring of protection for the target by determining a maximum projectile range for ammunition for the firearm and a predetermined safety margin range 208. The dynamic and changing diameter of the ring of protection outside of the no shoot zone of protection is equal to or greater than the maximum project range of the most powerful ammunition for that firearm recorded in the Firearms Distress and Safety System. The predetermined safety margin range can be pre-programmed and stored by the Firearms Distress and Safety System. In some implementations, the Firearms Distress and Safety System programmers may determine the safety margin as a percentage of the most powerful ammunition specified by the weapon manufacturer for a particular weapon. Therefore, the safety margin can be anywhere between 0% and 100% of the range of the ammunition.

The system also calculates a dynamic, no-shoot arc on each side of the changing relative bearing of the muzzle of the firearm and a safety margin of a preset number of degrees of arc 210. The core arc is an arc with the active shooter at the center of a circle from which the arc emanates. The arc includes the target 101 within the core of the arc. In some implementations, the system adds a safety margin of degrees/minutes/seconds to the core arc as predetermined or dynamically determined as a percentage of the core arc in order to expand the core arc on each of the arc sides. The safety margin could be between 0 to 360 degrees/minutes/seconds of the arc, i.e., at 360 degrees of arc, the active weapon would be rendered inoperable in any direction.

When the firearm is within a no-shoot zone surrounding the target as determined by the diameter of the calculated ring of protection and the no-shoot arc, the system sends a command to the on-firearm locking system to activate the on-firearm locking apparatus in order to prevent the firearm from being fired into the no-shoot zone 212.

FIG. 3 illustrates a microcircuit card/board for the on-firearm locking system 300. The on-firearm locking system 300 includes a power supply 310. The power supply 310 can be replaceable batteries or another rechargeable power supply coupled with an optional step down transformer 314 if the charging device does not have an integral step down transform with a recharging power port 316, e.g., a USB power port. The locking system 300 includes a central processing unit (CPU) 308. The CPU receives information from the communications transponder/receiver 312, the fluxgate compass 304, the power supply 310, and the data entry port 318. The CPU then applies data to a set of programmed rules within the CPU. One set of rules can instruct the switch processor 302 to engage the safety enabling/disabling switch 330 in the event of an interruption in power or when the storage capacity of the power supply 310 falls below a stated percentage, e.g., 10% of capacity. Another set of rules can tell the CPU to send information it receives and monitors from other units to the memory component 306 to maintain an active history of actions. Still another set of rules can enable the CPU to draw preprogrammed information in the CPU or memory component 306, or information downloaded by the Firearms Distress and Safety System 103 to the weapon, and then apply the information to another process determined by other rules of the CPU. The CPU may also be programmed to send the fluxgate 304 or the memory component 306 information to the Firearms Distress and Safety System 103 in real time. The CPU may also engage the switch processor and the safety enabling switch when the communications transponder/receiver 312 receives a signal to disable or enable the weapon at the edge of the variable no-penetration zone 110, within a certain no-shoot arc, or when the active weapon is outside of the variable no-penetration zone 110 or not within a certain no-shoot arc. The locking system 300 also includes a communications transponder/receiver 312 that receives commands to disable or enable the on-firearm locking apparatus. The transponder/receiver can include an integrated antenna. In some implementations, the on-firearm locking system receives these commands from the Firearms Distress and Safety System 103 or the target 101. The on-firearm locking system also includes a memory component 306. The system 300 also includes a fluxgate compass 304 for determining location information associated with the firearm. The CPU sends commands to a switching processor 302 to activate or disable the on-firearm locking apparatus. The system 300 additionally includes a hard wire or wireless connection 320 between the switching processor 302 and a remote trigger safety switch 330 proximate to a traditional on-firearm manual safety switch on the firearm.

In a preferred embodiment, all of the components except the hard wire or wireless connection 320 and the safety enabling/disabling switch 330 are miniaturized and mounted on a circuit card/board that can be integrated as an original equipment install into the butt, butt cap, or pistol grip of the firearm. The circuit board of FIG. 3 can be made small enough to fit into the receiving handle or grip of the weapon. Alternatively, the circuit card/board can be included as an aftermarket/retro refit into the butt, butt cap, or pistol grip of the firearm, e.g., as an overlay to the pistol grips or replacement pistol grips applied to the pistol handle of the firearm.

The hard wire or wireless connection between the switching processor and a remote trigger safety switch proximate to the traditional on-firearm manual safety switch can be mounted in the interior of the firearm and proximate to the traditional on-firearm manual safety switch in order that, when the remote trigger safety switch is engaged, a blocking pin or bolt is activated to block the release of the on-firearm manual safety switch If the on-firearm safety switch is in the "off" position rendering the firearm trigger and hammer as active, when the remote trigger safety switch is engaged, the on-firearm manual safety switch is engaged and slid to an "on" position, rendering the firearm inoperable.

To prevent the disablement of the firearm locking system, the system is pre-programmed to go into a non-unlockable locking mode when the firearm locking system is tampered with or if there is an attempt to remove the system. In one implementation, the system renders the weapon inoperative if the power supply is cut or varied substantially. In another implementation, the system renders the firearm inoperable if the power supply falls below a stated storage capacity, e.g., if the on-firearm locking system has 10% power or less of full battery strength.

Figure 4A:
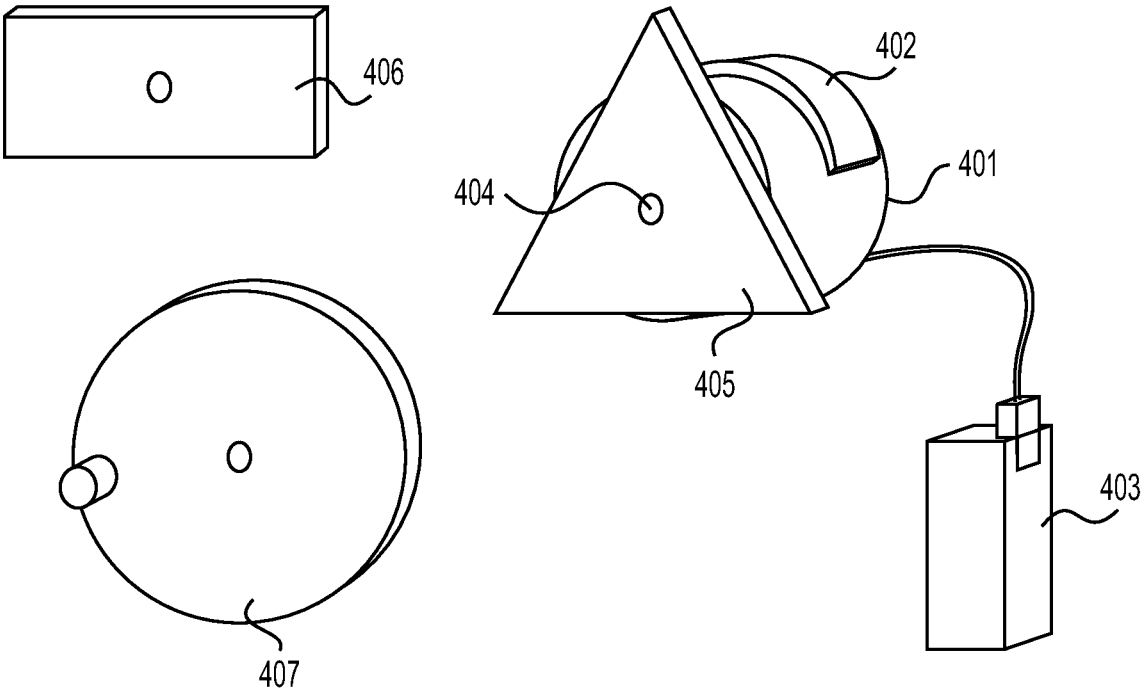
FIG. 4A illustrates an embodiment of an on-firearm locking apparatus of the on-firearm locking system that is enabled when it receives an enabling command from the safety enabling/disabling switch of FIG. 3.

FIG. 4A illustrates an embodiment of an on-firearm locking apparatus of the on-firearm locking system that is enabled when it receives an enabling command from the safety enabling/disabling switch of FIG. 3. In this version, a cam of irregular shape (i.e., rectangular, off-centered disc or triangular) can be fixed to a motor shaft. The system can turn the cam and thus lock the safety pin mechanism. In FIG. 4A, a microelectric motor 401 is connected to a wired or wireless communication device 402 that communicates with a communication device on the CPU of a locking system, e.g., locking system 300. The microelectric motor 401 is also connected to a power supply 403 that is connected to a CPU power supply or free standing. The rotor shaft 404 of the electric motor is affixed with a cam of irregular shape, e.g., triangular cam 405, rectangular cam 406, or off centered circular or oblong cam 407. When the cam is turned the system locks a safety pin mechanism, thus disabling the firearm from being discharged. When the microelectric motor 401 receives a signal to enable the firearm, the motor 401 turns the cam and unlocks the firearm to enable firearm use.

Figure 4B:
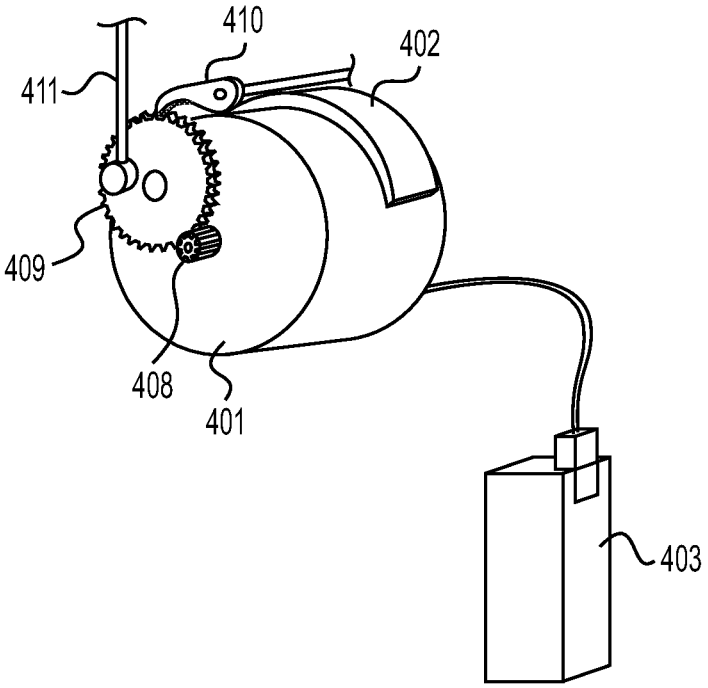
FIG. 4B illustrates an embodiment of an on-firearm locking apparatus of the on-firearm locking system that is enabled when it receives an enabling command from the safety enabling/disabling switch of FIG. 3.

FIG. 4B illustrates a second embodiment of an on-firearm locking apparatus of the on-firearm locking system that is enabled when it receives an enabling command from the safety enabling/disabling switch of FIG. 3. In this intermittent pin/ratchet/pawl version, a fly wheel or like disc can be fixed to the motor shaft and move an off-centered pin or piston into position as a locking mechanism against the pin in the weapon like the cam. The intermittent/ratchet/pawl or crank may be in the form of a toothed cam 408 that is either fixed on the micro-electric motor 401 or engaged with that toothed cam 408 by another gear plate 409 on which a pin or piston is offset 411 and a pawl/ratchet 410 is installed preventing the reversing of the gear once in position. This configuration allows the system to translate the circular motion of the micro-electric motor rotor to an angular vertical or horizontal piston motion that moves the locking pin in a similar manner to the manner in which a cam does in communal proximity to the locking pin. The pawl/ratchet is released when the safety is released to the "off" position When engaged, in one implementation, the locking pin prevents the trigger guard from releasing thus disabling the trigger. In another implementation, the locking pin prevents the firing pin from engaging against the charge. In still another implementation, the locking pin prevents the drop pin from disengaging from the drop block in the barrel.

Using either the version of FIG. 4A or FIG. 4B, the cam or the fly wheel/disc is fixed to a micro-electric motor rotor to actuate a locking pin against the trigger safety mechanism, or the firing pin, to prevent its movement against the charge, or to prevent the block that in turn prevents the drop pin affixed to the distal end of the firing pin shaft, from engaging into the operating position.

In another implementation, the micro-electric motor engages a housing containing a threaded pin or bolt that unscrews and thus elongates against the firing pin, the trigger pin, or the blocking pin preventing the pin from being disengaged.

Figure 4C:
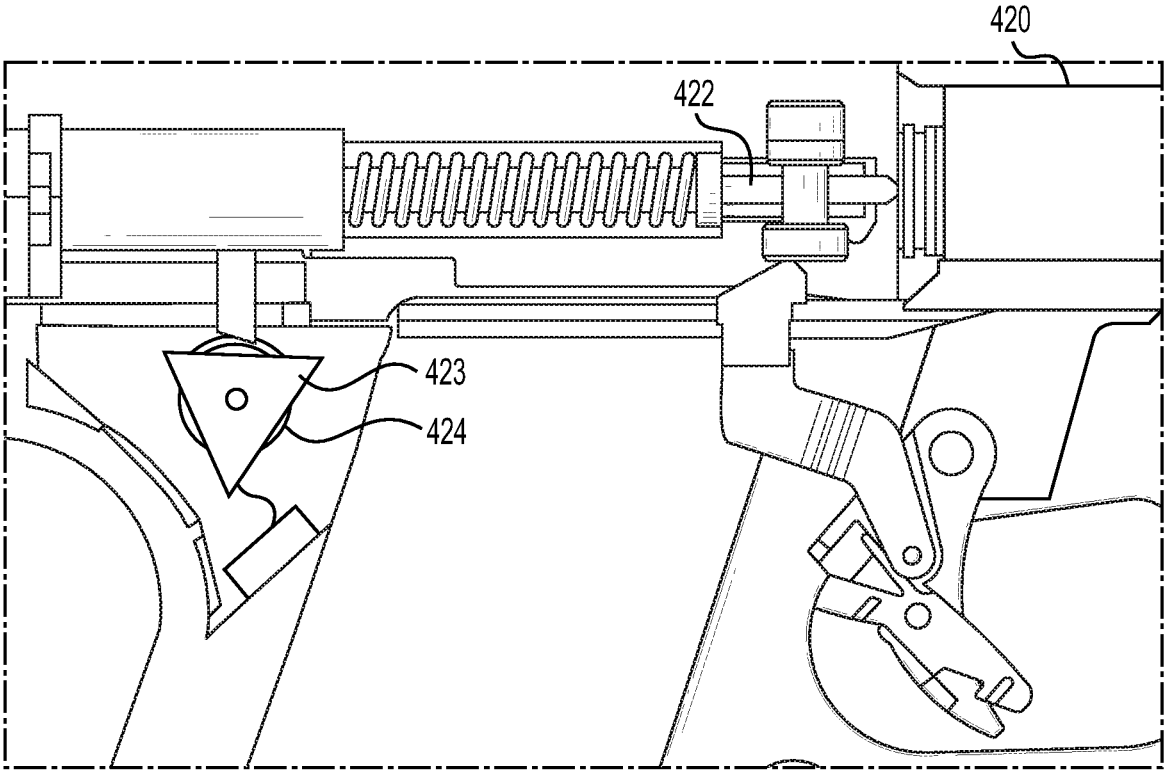
FIG. 4C illustrates a location of an on-firearm safety.

FIG. 4C illustrates a potential location of an on-firearm safety. A weapon barrel 420 includes a firing pin 422, a safety pin blocking pin 423, and a locking mechanism 424, e.g., one of the locking mechanisms from FIG. 4A or FIG. 4B. In this implementation, the blocking pin 423 is projected into the path of a firing pin 422 to prevent (or enable) the firing pin when the locking mechanism 424 is engaged (or disengaged).

Figure 4D:
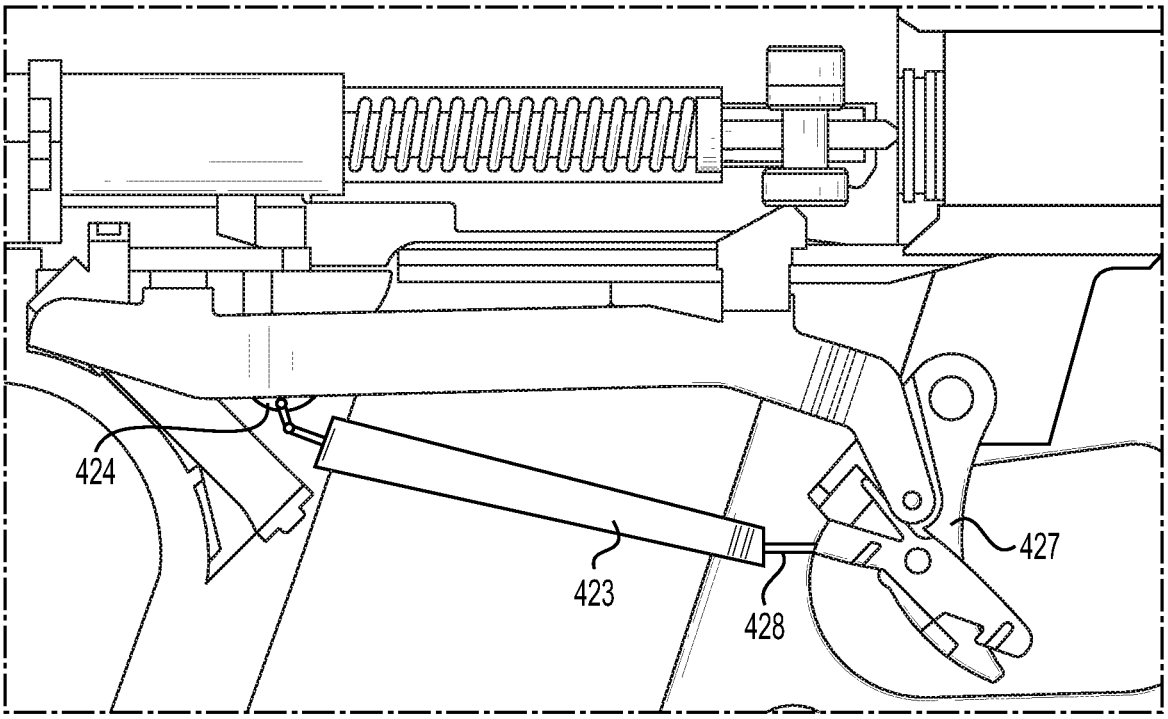
FIG. 4D illustrates an alternative location of an on-firearm safety.

FIG. 4D illustrates an alternative location of an on-firearm safety. In this implementation, the locking mechanism 424 ensures that the blocking pin 423 engages a finger trigger blocking shield 428 to disable/enable a finger trigger 427.

Figure 4E:
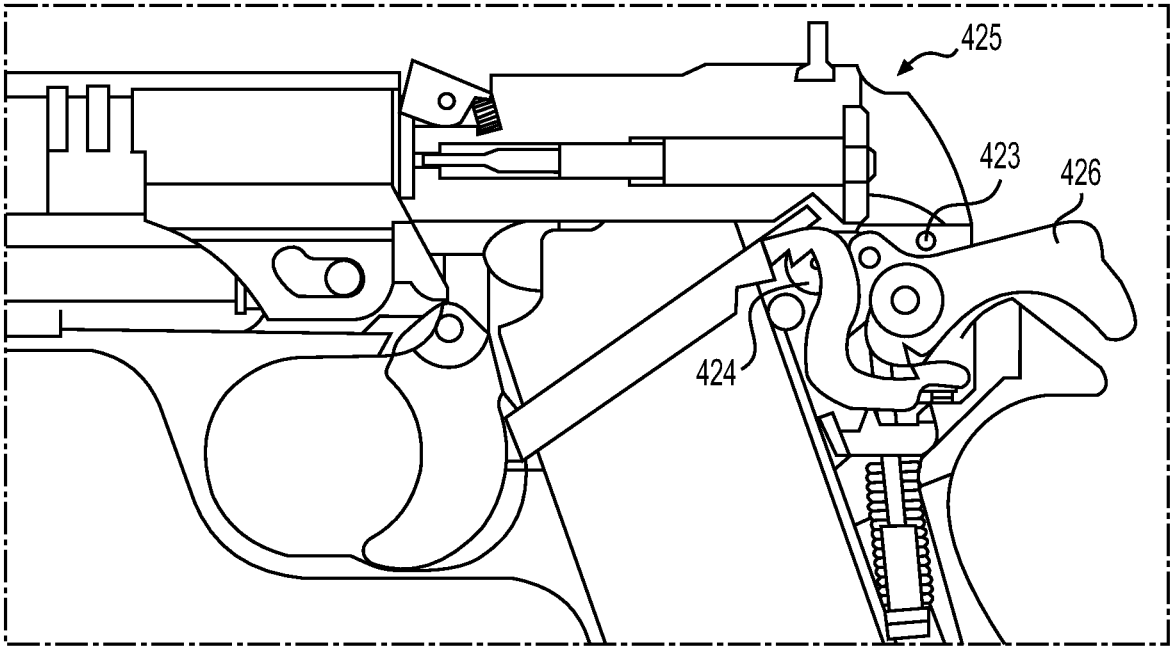
FIG. 4E illustrates an alternative location of an on-firearm safety.
Figure 5:
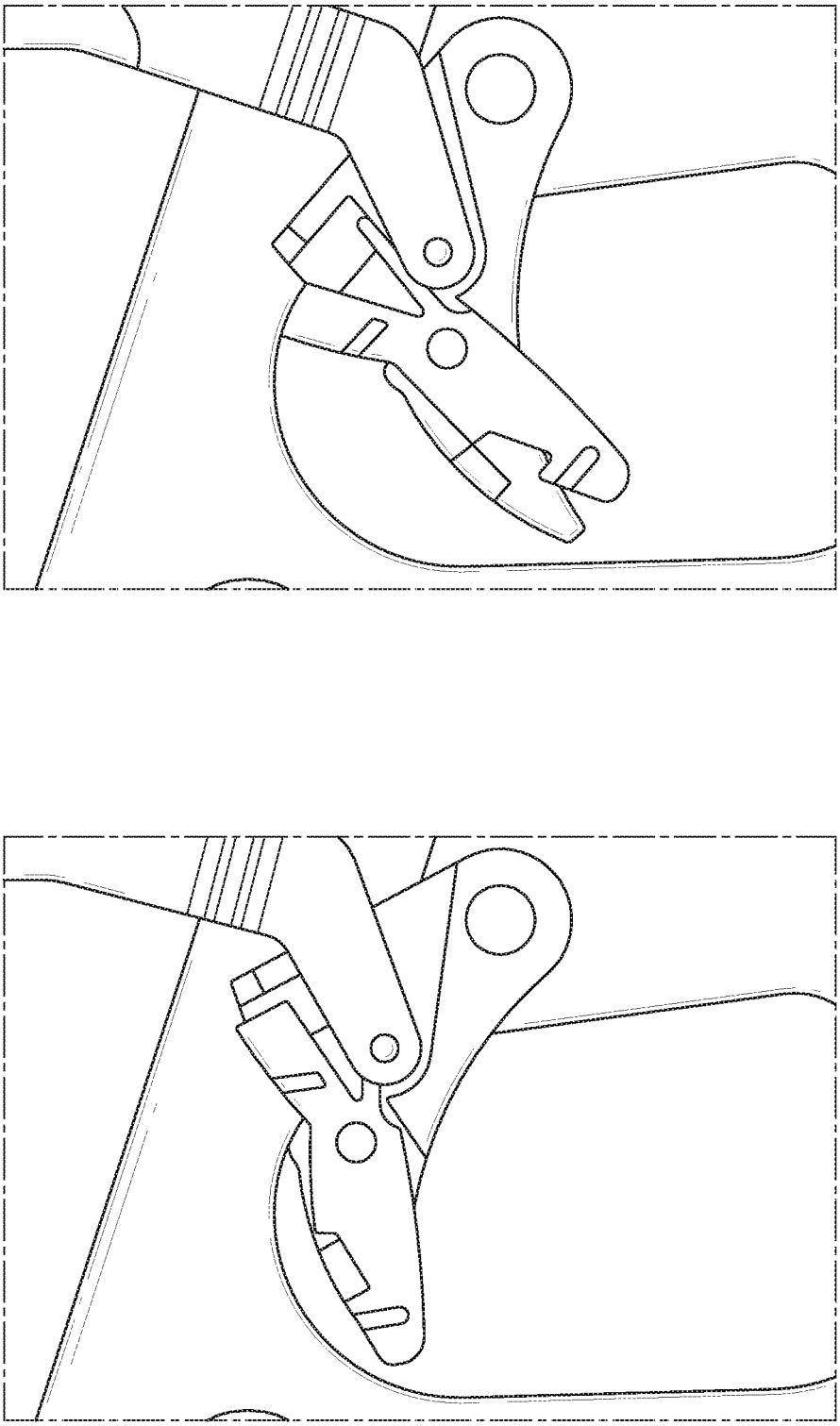
FIG. 5 illustrates a trigger safety of a firearm.
Figure 6:
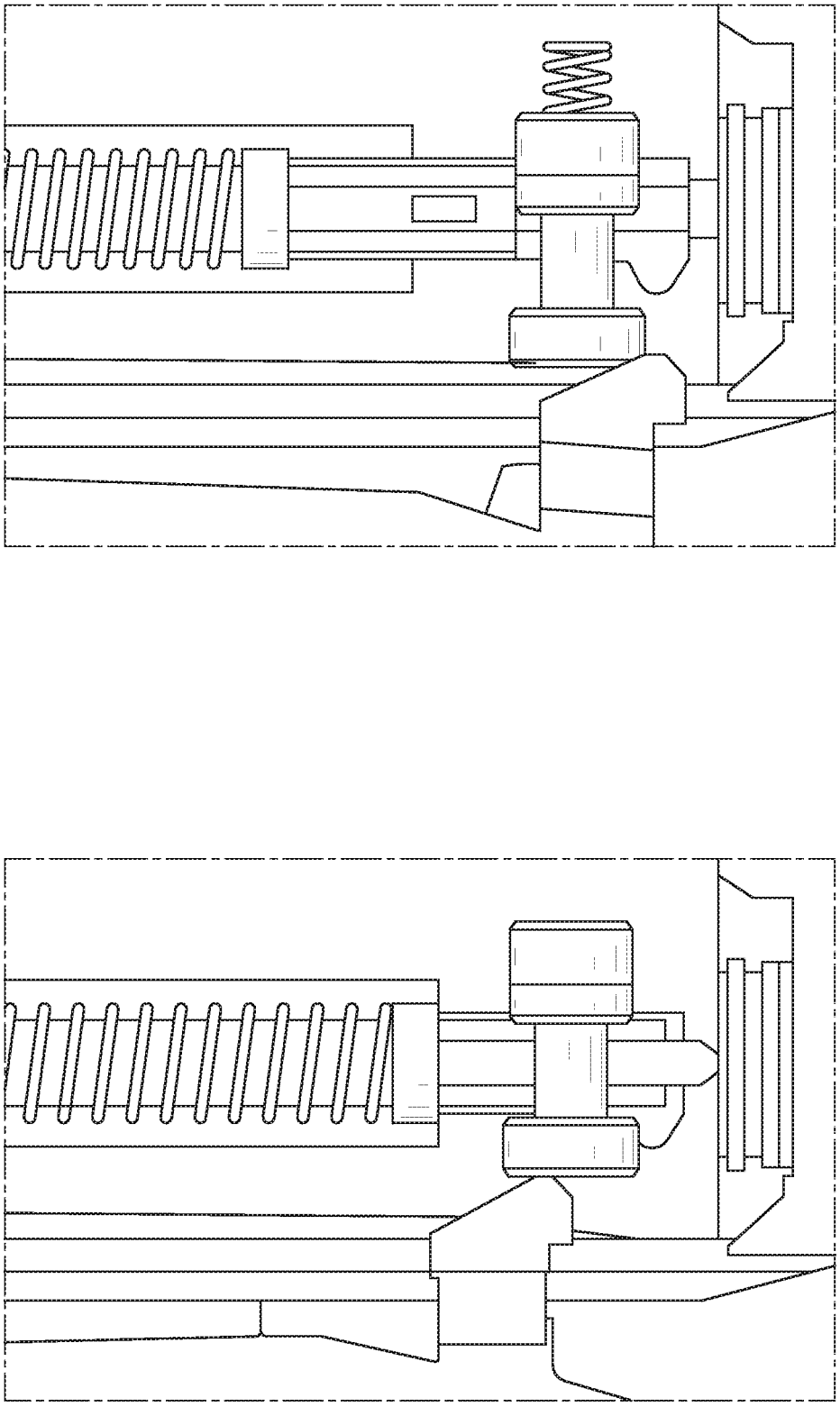
FIG. 6 illustrates a firing pin safety of a firearm.
Figure 7:
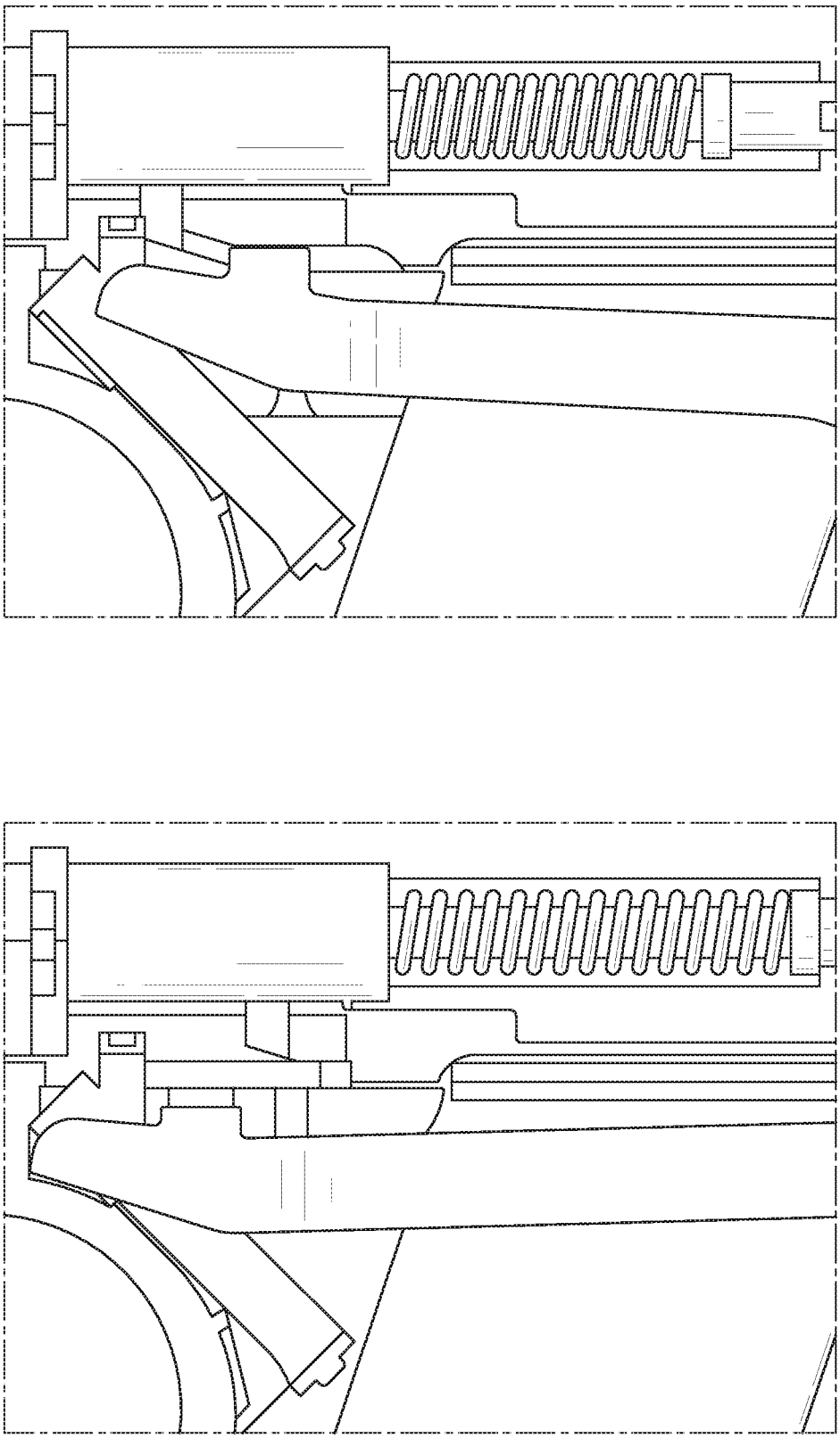
FIG. 7 illustrates a drop safety on a firing pin.

FIG. 4E illustrates still another alternative location of an on-firearm safety. In this implementation, the locking mechanism 424 ensures that the blocking pin 423 engages a hammer 426 or a hammer plate to prevent (or enable) the projection of the hammer or hammer plate from striking a charge.

Embodiments of the subject matter and the functional operations described in this specification can be implemented in digital electronic circuitry, in tangibly-embodied computer software or firmware, in computer hardware, including the structures disclosed in this specification and their structural equivalents, or in combinations of one or more of them. Embodiments of the subject matter described in this specification can be implemented as one or more computer programs, i.e., one or more modules of computer program instructions encoded on a tangible non-transitory storage medium for execution by, or to control the operation of, data processing apparatus. The computer storage medium can be a machine-readable storage device, a machine-readable storage substrate, a random or serial access memory device, or a combination of one or more of them. Alternatively or in addition, the program instructions can be encoded on an artificially-generated propagated signal, e.g., a machine-generated electrical, optical, or electromagnetic signal, that is generated to encode information for transmission to suitable receiver apparatus for execution by a data processing apparatus.

The term "data processing apparatus" refers to data processing hardware and encompasses all kinds of apparatus, devices, and machines for processing data, including by way of example a programmable processor, a computer, or multiple processors or computers. The apparatus can also be, or further include, special purpose logic circuitry, e.g., an FPGA (field programmable gate array) or an ASIC (application-specific integrated circuit). The apparatus can optionally include, in addition to hardware, code that creates an execution environment for computer programs, e.g., code that constitutes processor firmware, a protocol stack, a database management system, an operating system, or a combination of one or more of them.

A computer program, which may also be referred to or described as a program, software, a software application, an app, a module, a software module, a script, or code, can be written in any form of programming language, including compiled or interpreted languages, or declarative or procedural languages; and it can be deployed in any form, including as a stand-alone program or as a module, component, subroutine, or other unit suitable for use in a computing environment. A program may, but need not, correspond to a file in a file system. A program can be stored in a portion of a file that holds other programs or data, e.g., one or more scripts stored in a markup language document, in a single file dedicated to the program in question, or in multiple coordinated files, e.g., files that store one or more modules, sub-programs, or portions of code. A computer program can be deployed to be executed on one computer or on multiple computers that are located at one site or distributed across multiple sites and interconnected by a data communication network.

The processes and logic flows described in this specification can be performed by one or more programmable computers executing one or more computer programs to perform functions by operating on input data and generating output. The processes and logic flows can also be performed by special purpose logic circuitry, e.g., an FPGA or an ASIC, or by a combination of special purpose logic circuitry and one or more programmed computers.

Computers suitable for the execution of a computer program can be based on general or special purpose microprocessors or both, or any other kind of central processing unit. Generally, a central processing unit will receive instructions and data from a read-only memory or a random access memory or both. The essential elements of a computer are a central processing unit for performing or executing instructions and one or more memory devices for storing instructions and data. The central processing unit and the memory can be supplemented by, or incorporated in, special purpose logic circuitry. Generally, a computer will also include, or be operatively coupled to receive data from or transfer data to, or both, one or more mass storage devices for storing data, e.g., magnetic, magneto-optical disks, or optical disks. However, a computer need not have such devices. Moreover, a computer can be embedded in another device, e.g., a mobile telephone, a personal digital assistant (PDA), a mobile audio or video player, a game console, a Global Positioning System (GPS) receiver, or a portable storage device, e.g., a universal serial bus (USB) flash drive, to name just a few.

Computer-readable media suitable for storing computer program instructions and data include all forms of non-volatile memory, media and memory devices, including by way of example semiconductor memory devices, e.g., EPROM, EEPROM, and flash memory devices; magnetic disks, e.g., internal hard disks or removable disks; magneto-optical disks; and CD-ROM and DVD-ROM disks.

To provide for interaction with a user, embodiments of the subject matter described in this specification can be implemented on a computer having a display device, e.g., a CRT (cathode ray tube) or LCD (liquid crystal display) monitor, for displaying information to the user and a keyboard and a pointing device, e.g., a mouse or a trackball, by which the user can provide input to the computer. Other kinds of devices can be used to provide for interaction with a user as well; for example, feedback provided to the user can be any form of sensory feedback, e.g., visual feedback, auditory feedback, or tactile feedback; and input from the user can be received in any form, including acoustic, speech, or tactile input. In addition, a computer can interact with a user by sending documents to and receiving documents from a device that is used by the user; for example, by sending web pages to a web browser on a user's device in response to requests received from the web browser. Also, a computer can interact with a user by sending text messages or other forms of message to a personal device, e.g., a smartphone, running a messaging application, and receiving responsive messages from the user in return.

Embodiments of the subject matter described in this specification can be implemented in a computing system that includes a back-end component, e.g., as a data server, or that includes a middleware component, e.g., an application server, or that includes a front-end component, e.g., a client computer having a graphical user interface, a web browser, or an app through which a user can interact with an implementation of the subject matter described in this specification, or any combination of one or more such back-end, middleware, or front-end components. The components of the system can be interconnected by any form or medium of digital data communication, e.g., a communication network. Examples of communication networks include a local area network (LAN) and a wide area network (WAN), e.g., the Internet.

The computing system can include clients and servers. A client and server are generally remote from each other and typically interact through a communication network. The relationship of client and server arises by virtue of computer programs running on the respective computers and having a client-server relationship to each other. In some embodiments, a server transmits data, e.g., an HTML page, to a user device, e.g., for purposes of displaying data to and receiving user input from a user interacting with the device, which acts as a client. Data generated at the user device, e.g., a result of the user interaction, can be received at the server from the device.

While this specification contains many specific implementation details, these should not be construed as limitations on the scope of any invention or on the scope of what may be claimed, but rather as descriptions of features that may be specific to particular embodiments of particular inventions. Certain features that are described in this specification in the context of separate embodiments can also be implemented in combination in a single embodiment. Conversely, various features that are described in the context of a single embodiment can also be implemented in multiple embodiments separately or in any suitable subcombination. Moreover, although features may be described above as acting in certain combinations and even initially be claimed as such, one or more features from a claimed combination can in some cases be excised from the combination, and the claimed combination may be directed to a subcombination or variation of a subcombination.

Similarly, while operations are depicted in the drawings in a particular order, this should not be understood as requiring that such operations be performed in the particular order shown or in sequential order, or that all illustrated operations be performed, to achieve desirable results. In certain circumstances, multitasking and parallel processing may be advantageous. Moreover, the separation of various system modules and components in the embodiments described above should not be understood as requiring such separation in all embodiments, and it should be understood that the described program components and systems can generally be integrated together in a single software product or packaged into multiple software products.

Particular embodiments of the subject matter have been described. Other embodiments are within the scope of the following claims. For example, the actions recited in the claims can be performed in a different order and still achieve desirable results. As one example, the processes depicted in the accompanying figures do not necessarily require the particular order shown, or sequential order, to achieve desirable results. In some cases, multitasking and parallel processing may be advantageous.

What is claimed is:

1. A method comprising:

determining that a firearm with an on-firearm locking system is within a predetermined distance of a target affixed with a transmitter/receiver safety device;

tracking the firearm, including a location of the firearm as well as a type of the firearm and an owner of the firearm, while the firearm is within the predetermined distance of the target;

determining whether a muzzle of the firearm has a relative bearing to the target;

calculating a diameter of a ring of protection for the target by determining a maximum projection range for ammunition for the firearm and a predetermined safety margin range;

calculating a no-shoot arc for the firearm using a safety margin of a predetermined amount of degrees of arc and the relative bearing of the muzzle of the firearm; and sending a command to activate the on-firearm locking system of the firearm when the firearm is within a no-shoot zone surrounding the target, as determined by the diameter of the ring of protection and the no-shoot arc, to prevent the firearm from being fired into the no-shoot zone.

2. The method of claim 1, wherein the no-shoot zone is defined by two zones, a non-operative shooting zone with the target at its center and a variable no-penetration zone for each particular weapon that serves as a ring surrounding the non-operative shooting zone.

3. The method of claim 1, further comprising:

sending a command to deactivate the on-firearm locking system of the firearm when the firearm is outside the no-shoot zone.

4. The method of claim 1, further comprising:

tracking communication devices within the predetermined distance of the target; and sending messages to the communication devices with safety instructions when the firearm is within the predetermined distance of the target.

5. The method of claim 1, wherein the target is a cluster of communication devices identified in a specific geographic area.

6. The method of claim 2, wherein the variable no-penetration zone for a particular firearm is determined by adding a predetermined distance to the non-operative shooting zone based on characteristics of the particular firearm.

7. The method of claim 6, wherein the predetermined distance to be added is calculated based on the firearm make, a maximum ammunition load for the firearm, a shooting distance for the maximum ammunition load, and a fixed safety margin expressed as an additional percentage of a maximum shooting distance for the ammunition load.

8. The method of claim 1, further comprising: prior to sending the command to activate the on-firearm locking system of the firearm, determining whether the firearm is authorized to work within the no-shoot zone surrounding the target; and sending the command to activate the on-firearm locking system of the firearm upon determination that the firearm is not authorized to work within the no-shoot zone.

* * * * *